United States Patent [19]

Spiegel et al.

[11] 3,967,566

[45] July 6, 1976

[54] SEWING MACHINE ATTACHMENT

[76] Inventors: Murray Spiegel, 5724 Davies, Cote-St.-Luc, Montreal; Mitchell Spiegel, 374 Andras Drive, Dollad-des-Ormeaux, Quebec, both of Canada

[22] Filed: Aug. 21, 1974

[21] Appl. No.: 499,136

[52] U.S. Cl. ..... 112/219 A

[51] Int. Cl.[2] ..... D05B 69/26

[58] Field of Search ..... 112/219 A, 219 R, 67, 112/87, 220, 221

[56] References Cited

UNITED STATES PATENTS

| | | | |
|---|---|---|---|
| 2,759,444 | 8/1956 | Schwab et al. | 112/219 A |
| 2,967,499 | 1/1961 | Cohen | 112/219 A |
| 3,149,593 | 9/1964 | Johnston | 112/219 A |
| 3,174,450 | 3/1965 | Becker et al. | 112/219 A |
| 3,237,579 | 3/1966 | Medynski et al. | 112/219 A |
| 3,622,854 | 11/1971 | Osaka et al. | 112/219 A |
| 3,804,043 | 4/1974 | Benson et al. | 112/219 A |
| 3,818,849 | 6/1974 | Maddox | 112/219 A |

FOREIGN PATENTS OR APPLICATIONS

| | | | |
|---|---|---|---|
| 193,295 | 5/1967 | U.S.S.R. | 112/219 A |

*Primary Examiner*—H. Hampton Hunter

[57] ABSTRACT

A machine, for example a sewing machine, including a cyclically movable motor-driven element and comprising a motor for cyclically driving the element through a drive transmission. The motor has a drive shaft connected to a first input member of the drive transmission by a releasable coupling. Means are provided to release the coupling and to activate an auxiliary drive coupled to a second input member of the drive transmission. The auxiliary drive is operative to continue the drive to the driven element after the coupling has been released. Means are provided indicating a predetermined position in which the drive element is to be stopped. Sensing means are provided for sensing the indicating means. A brake disc is movably connected to an output member of the drive transmission. Means are provided to magnetically move the brake disc to brake the drive transmission output member in response to the sensing means and to disconnect the auxiliary drive means whereby to stop the driven element within one complete cycle of movement of the driven element and substantially at the predetermined position.

7 Claims, 5 Drawing Figures

SEWING MACHINE ATTACHMENT

BACKGROUND OF INVENTION a. Field of Invention

The present invention relates to a control device for positioning a motor driven element. More specifically, it relates to a device for stopping a sewing machine with the needle in a selected position and incorporating a relatively simple device.

An embodiment of the present invention may further include an inching control for slow speed operation of the machine so that the machine can be advanced one stitch at a time.

b. Description of Prior Art

Machines manufactured in accordance with the present invention have many advantages over prior art machines. For example, with the described arrangement a faster cycle is permitted in that the number of stitches formed after the treadle has been released need never exceed two, which permits the operator to more closely approach a predetermined spot while the machine is operating at top speed. Furthermore, the needle positioners of the prior art require treadle pressure to brake the machine whilst an embodiment of the present invention uses an electrical system thereby reducing operator fatique.

SUMMARY OF INVENTION

An embodiment of the present invention also provides a system that substantially eliminates the use of movable clutches and relays, thereby obtaining a time advantage which permits the rapid stopping as above described. This system will allow edge and length control sewing automatically providing a reliable means without manual control by the operator.

It is also possible with the type of circuitry proposed herein to provide a system of easy servicing and to reduce the maintenance required by means of a modular construction and signal devices indicating a defective module to be replaced.

From a broad aspect, the present invention provides a control device for use with a motor driven element in a sewing machine or the like, and comprising a main motor having a drive shaft for driving said element through a clutching mechanism, means to disengage said clutch mechanism from said driven element and to activate an auxiliary motor, said auxiliary motor continuing the drive of said driven element after said main motor drive has been disengaged through said clutching mechanism, means indicating a predetermined position where said driven element is to be stopped, sensing means for sensing said means to indicate a position, a floating brake coupling having a movable plate connected to said drive shaft, means to disconnect said auxiliary motor and to magnetically move said movable plate to brake the drive of said driven element in response to said sensing means and within one complete cycle of operation of said element and substantially at each predetermined position.

While the device to be described herein below has been directed specifically to the positioning of a needle on an industrial sewing machine, it may be used as a positioner on any tool having suitable characteristics that will allow rapid braking.

BRIEF DESCRIPTION OF DRAWINGS

The specific improvements and advantages of the present invention will become more apparent from the following detailed description of a preferred embodiment thereof, given by way of example only, taken in conjunction with the accompanying drawings in which.

DESCRIPTION OF PREFERRED EMBODIMENTS

Figure 1:
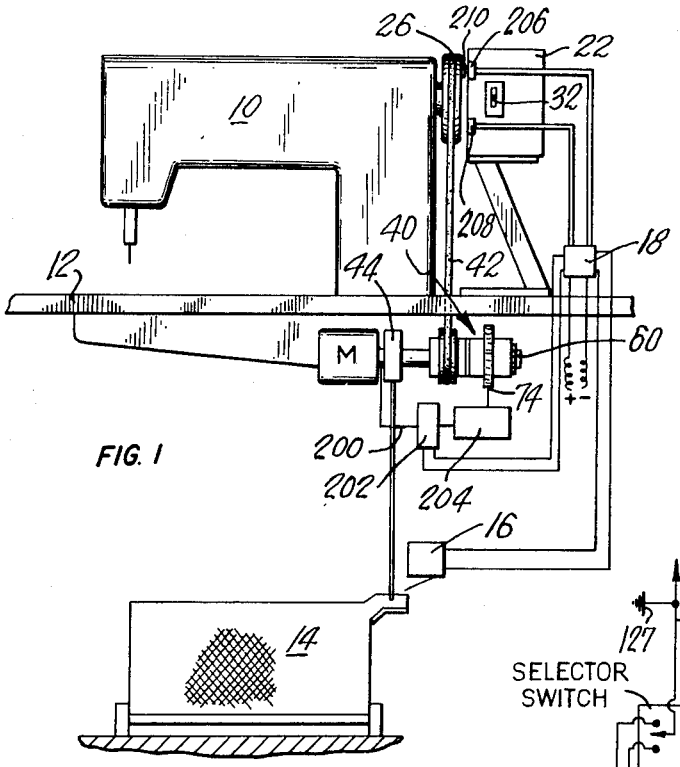
FIG. 1 is an elevation view schematically illustrating the present invention as applied to a conventional sewing machine.

As shown in FIG. 1 a sewing machine 10 has a table 12 with a treadle mechanism or pedal 14 therebelow. The treadle mechanism 14 actuates micro-switches 1, 2 connected to a control box 18.

The machine 10 is driven from a clutch mechanism 40 by a drive belt 42, either directly from the main motor M, or by way of a controlled clutch 202 and a speed reducer 204 from an auxiliary drive shaft 200 connected to the shaft of motor M. When the pedal 14 is depressed main motor M drives the drive shaft 60 of the clutch mechanism 40 through a coupling 44 and this shaft in turn drives the main pulley 62 of the clutch mechanism 40 in a manner to be described hereinbelow.

Figure 2:
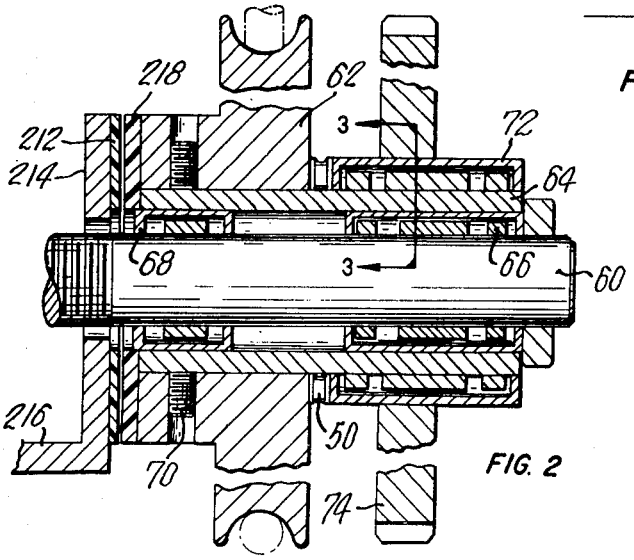
FIG. 2 is a section through the clutch mechanism.
Figure 3:
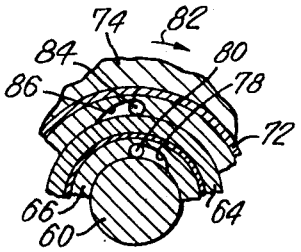
FIG. 3 is a view along the line 3—3 of FIG. 2.

The clutch mechanism 40 is best shown in FIGS. 2 and 3 including a shaft 60 driven from the motor M and preferably mounted coaxial with the shaft of motor M. Mounted on the shaft 60 is a sleeve 64 which is fixed to bearings 66 and 68 and is freely rotatable relative to the shaft 60 in one direction via the bearings 66 and 68 and locked to the shaft upon relative movement of the shaft and sleeve 64 in the opposite direction. The main pulley 62 is fixed to the sleeve 64 in any suitable manner, as in the illustrated arrangement, via set screws 70.

A gear 74 is fixed to the clutch mechanism by way of a one-way bearing 72 whereby the auxiliary drive 200 may drive the sleeve 64 through gear 74 and bearing 72. The bearing 72 is similar to the bearings 66 and 68 and permits relative rotation of the sleeve 64 and gear 74 in one direction while preventing relative movement in the opposite direction.

A suitable thrust bearing 50 is interposed between the pulley 62 and the bearing 72.

As shown in FIG. 3 the one-way bearings that obtain the operation described above have been schematically illustrated. As shown, the bearing 66 or 68 is provided with a tapered slot 78 in which is mounted a roller 80 so that rotation of the shaft in one direction moves the roller deep into the slot and permits free movement of the bearing and thus relative movement between sleeve 64 and shaft 60. Relative movement of the shaft 60 and sleeve 64 in the opposite direction moves the roller 80 into wedging engagement between the groove 78 in the bearing and the shaft 60 whereby a driving force and rotational movement is transmitted to the sleeve 64 through the bearing 66 and 68. This rotational movement obviously turns the pulley 62 to drive the belt 42 and the sewing machine 10.

When the treadle 14 is released the main motor M is disengaged via coupling 44 and shaft 60 is braked by the coupling 44. When the controlled clutch 202 is operated the auxiliary drive 200 drives the gear 74 in the direction of the arrow 82 which moves the bearing 72 and the tapered groove 86 to force the roller 84 into wedging engagement with the sleeve 64 to drive the sleeve 64 in the same direction as it was driven by the shaft 60 and further rotate the pulley 62 until the controlled clutch 202 is disengaged.

In the embodiment shown the controlled clutch 202 is an electro-magnetic clutch and is controlled from the control box 18 to selectively connect the rotating transmission of auxiliary drive shaft 200 to the speed reducer 204 which drives the gear 74 of the coupling 40.

The sewing machine is provided with a sensing mechanism 22 to sense when the needle is in its highest or lowest position. This sensing mechanism utilises reed type switches 206 and 208 which selectively can be rendered active and which are controlled by a magnet 210. The orientation of the magnet 210 relative to the reed switches determines the magnetic forces applied by the magnet to the switches 206 and 208. The magnet can, for example, be positioned such that only a single pulse will be applied to the reed switch as the magnet passes the switch. In contrast, by positioning the magnet so that both north and south poles pass close to the switch as the wheel rotates two separate but rapid signal pulses will be generated.

The sewing machine is further provided with a braking device 212, which as can be seen from FIG. 2 includes a fixed plate 214 fixed to the frame of the machine schematically indicated at 216 and incorporating electro-magnetic coils (not shown) which may be operated to attract a movable plate 218 constituting a floating coupling connected to but movable axially relative to the pulley 62. When the coils in the plate 214 are actuated via the sensing reed switches 206 and 208, the plate 218 contacts the plate 214 to brake the machine.

Operation of the above described sewing machine is as follows:

In order to commence sewing the operator depresses treadle 14 to operate coupling 44 to connect the shaft 60 of the clutch mechanism 40 with the rotating shaft of motor M. The shaft 60 in turn drives the wheel 26 of the machine by way of bearings 66, 68, sleeve 64, pulley 62 and belt 42.

Either before sewing commences or during sewing a switch 32 of the sensing mechanism is positioned to replace a selected one of the reed switch 206, 208 in the circuit of the control box 18. According to which of the switches 206, 208 is placed in the circuit of the control box 18 the machine will be stopped upon the release of treadle either with the needle in its uppermost position or with the needle in its lowermost position.

Upon release of the treadle 14 the coupling 44 disengages shaft 60 from the rotating shaft of motor M and a projection on the treadle closes microswitches 1,2. Closing of the microswitches 1,2 activates the circuit of the control box 18 to operate the braking device 212 to brake the rotating pulley and thereby the rotating parts of the machine 10 and at the same time to engage the controlled clutch 202 to drive the pulley 62 and thereby the machine 10 at a reduced speed by way of auxiliary drive 200, controlled clutch 202, speed reducer 204 and gear 74. The machine is driven at this reduced speed until the magnet 210 next traverses the selected one of reed switches 206, 208, whereupon a signal is sent by the selected reed switch to the control base 18 to disengage controlled clutch 202. Upon disengagement of controlled clutch 202 the machine 10 is very quickly braked to standstill by braking device 212.

It will be appreciated that whilst in the embodiment described above the auxiliary drive to the pulley 62 after the coupling 44 has disengaged the shaft 60 from the shaft of motor M is effected by way of a shaft driven by the main motor and a controlled clutch, other forms of auxiliary drive are possible. For example, auxiliary drive shaft 200, controlled clutch 202 and speed reducer 204 may be replaced by an auxiliary motor controlled by the circuitry of control box 18.

In the above described embodiment the clutch 40 is mounted in line with the motor shaft of motor M. It will be apparent however, that this device could be mounted on the hand wheel of the machine or in any other suitable position.

In the arrangements illustrated only one form of one-way clutch has been illustrated, however, other forms can be used in the arrangement modified to accept these other forms of clutches. For example, the applicant is aware of a one-way clutch made by the 3M Company and utilizing 3M Fibre Tran dry facings. Special facings of Velcro (registered Trade Mark) type material may also be used for the one-way clutch. These clutch mechanisms could be used on a shaft between the main drive and the auxiliary drive in place of the clutch arrangement shown.

Any suitable control circuit may be used in control box 18 to control operation of the sewing machine in the manner described above. One suitable form of control circuit for use with the above described arrangement using an auxiliary motor to provide the auxiliary drive to pulley 62 will now be described, by way of example only.

Figure 4:
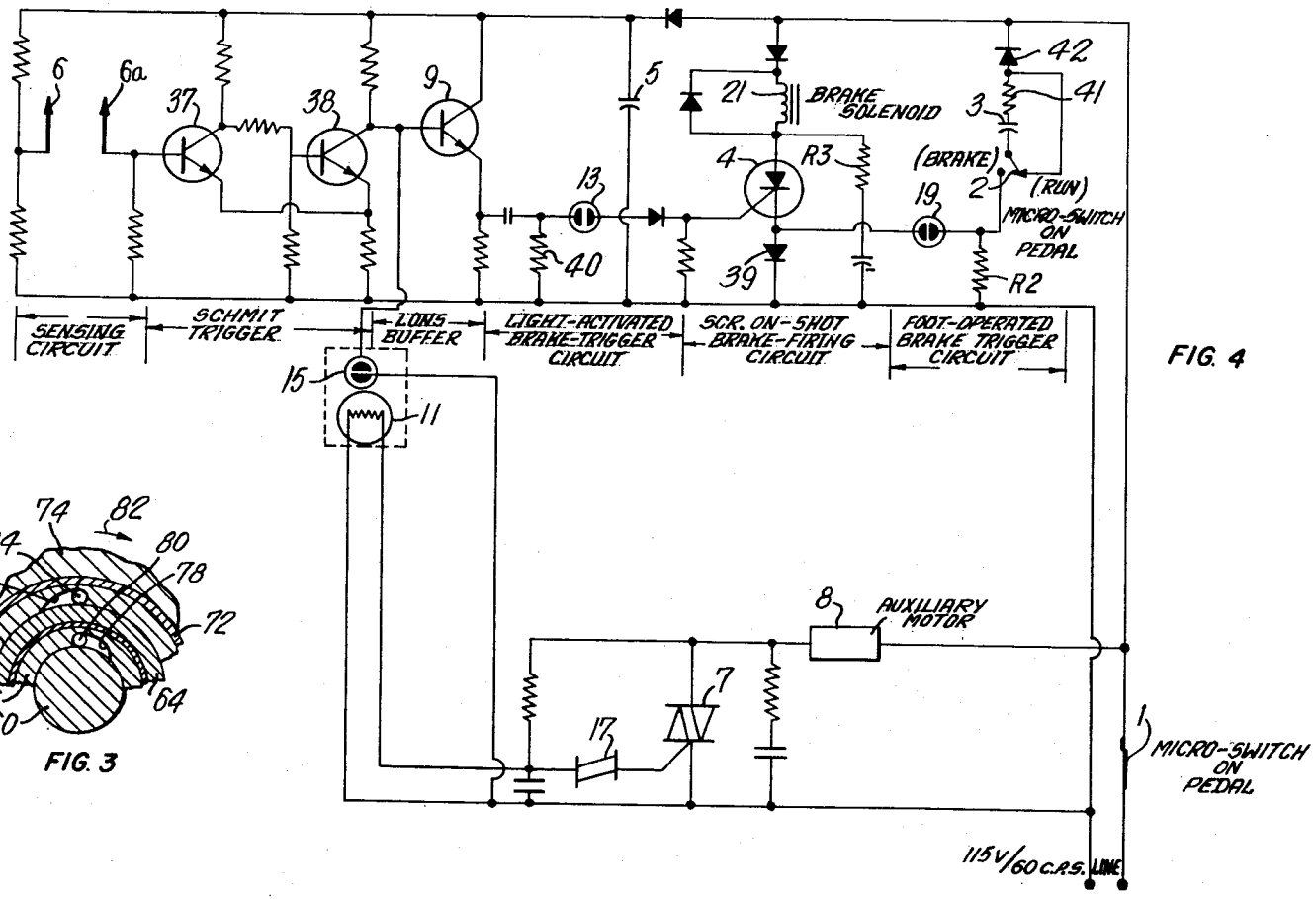
FIG. 4 is a schematic wiring diagram for one form of control mechanism.

The preferred wiring arrangement shown in FIG. 4 includes foot pedal actuated microswitches 1,2 which are closed when the foot pedal for operating the main motor of the machine is released.

When switches 1 and 2 close, capacitor 3 starts charging on first negative half cycle. During the first positive half cycle the brake solenoid operates as capacitor 3 charges through diode 42, solenoid 21 and resistor R3, operating brake. During next negative half cycle anode of SCR4 is positive due to charge on C1 and cathode is negative due to voltage drop across charging resistor R2. SCR4 fires discharging C1. Capacitor 3 fully charged after about one cycle and charging current drops to zero. Effect is that brake operates once only on release of pedal.

The current flow of the microswitch circuit as shown in FIG. 4 is as follows. When the brake is in the "on" position, during the positive half cycle of the voltage across the circuit, current will flow through the 100 ohm resistor 40, through the gate-cathode junction of SCR4, through the neon light 19, the brake switch, and the series connection of capacitor 3, resistor 41 and diode 42. During the negative half cycle, the capacitor 3 is now charged and therefore no current can flow through the gate-cathode junction or further fire the SCR4. Capacitor 3 discharges when the brake microswitch 2 is in the "run" position. The discharge path is through the loop formed with the resistor 41. The circuit is now ready for the next cycle.

It can be seen that the switch 1 connects the overall circuit to power so that when the machine is running there is no power in the control circuit and therefore there can be no accidental misfiring. It will be also noted that the auxiliary motor 8 is connected into the circuit with the closing of the micro-switch 1. This auxiliary motor 8 is activated through the triac 7.

The selected one of the reed switches 206, 208 selected by switch 32 is connected to the control circuit by way of conductors 6, 6a. The selected switch 206 or 208 deactivates the auxiliary motor 8 when the needle is in the preselected position depending on which of the switches has been selected. Also, by way of a buffer transistor 9 and a silicon controlled rectifier 4 (hereinafter called SCR4) the selected switch actuates the brake solenoid 21 to stop the machine as will be described hereinbelow.

Simultaneously with the actuation of the transistor 9 a light 15 is actuated which controls the auxiliary motor 8 by way of a light sensitive device 11 which causes the trigger 17 to deactivate the triac 7 and stop the motor 8.

Suitable signal indicators in the form of light bulbs give a visual indication of the sequence of operations of the device. These light bulbs indicated at 15, 13, and 19 also serve to indicate when a portion of the circuit is not operating properly. If one of these lights does not light, it will indicate that that portion of the circuit is non-functional. By using a module the nonfunctional module can be simply lifted from the machine and a new module inserted to render the machine operable again.

Briefly the operation of the circuit is as follows. The foot pedal 14 is released closing the microswitch 1 thereby applying power to the control circuit. The switch 2 is moved to the brake position and the condenser 3 discharges through the light 19, the rectifier 39 in line with the controlled rectifier 4, and the condenser 5 to actuate the brake solenoid 21 and thereby causing operation of the brake. This first operation of the brake 212 slows the operation of the machine down to say approximately 200 RPM. When the magnet 210 next transverses the selected one of the reed switches 206, 208 the selected switch is closed and operates the Schmit trigger and thus the transistor 9 and finally the SCR4 to trigger the brake for the second time and stop the operation. Simultaneously the light 15 is activated to actuate the photoelectric cell 11 to operate the trigger 17 and close off the triac 7 and thereby stop the motor 8.

An inching control may be provided by adding a switch (not shown) by passing the selected one of switches 206, 208 so that by operator control this switch can be actuated to turn off the light 15, to permit the auxiliary motor 8 to restart and drive the machine and releasing of this switch again operates the brake through the SCR4 and stops the motor 8. This will permit the formation of one or two stitches at slow speed or as many individual stitches as desired.

If desired, the machine may be driven continuously by the auxiliary motor 8 at a slower speed than the operating speed of the main motor M. Provision may also be made for varying the speed of the auxiliary motor 8 either electronically or mechanically so that the operator can select the speed best suited for the work in progress.

Figure 5:
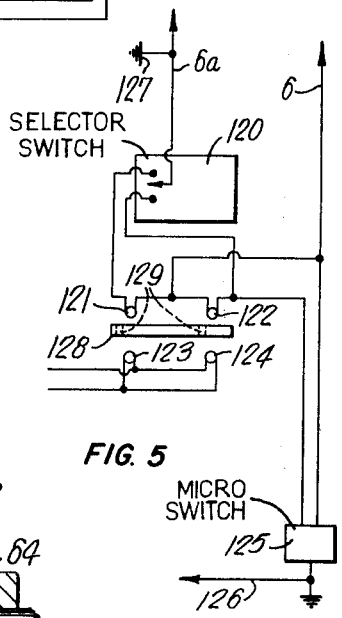
FIG. 5 is a schematic illustration of a modified sensing switch arrangement.

Referring now to FIG. 5 there is shown a modification of the above described sensing mechanism. The modified mechanism comprises light sensors 121, 122 either of which may be selectively connected between conductors 6, 6a by means of selector switch 120. The sensors 121, 122 operate in a manner analogous to reed switches 206, 208 and are activated by light from light emitting diodes 123, 124. An apertured disc 128, rotatable with a suitable member of the drive train of the sewing machine, for example with the wheel 26, is provided between light emitting diodes 123, 124 and sensors 121, 122. The apertures 129 in the disc 128 are positioned such that when the needle is in its uppermost position one of the sensors 121, 122 is exposed to the light of its respective light emitting diode whilst when the needle is in its lowermost position the other of the sensors 121, 122 is exposed to the light of its respective light emitting diode. The circuit of FIG. 5 further includes a microswitch 125 which may be operated to connect conductors 6, 6a.

The sequence can now be such that when the operator commences to sew, the switch 120 having been placed in its selected position for the needle-up or needle-down, and upon approaching the end of a seam, the microswitch 125 is actuated causing the machine to continue sewing to a predetermined length as determined by an auxiliary sensor connected to connection 126. This will automatically bring the machine to a halt in the position as determined previously by the operator. This positioning is achieved by the synchronizing disc 128 and light emitting diodes 123 and 124 and sensors 121 and 122. At the instant light hits the sensors via the holes 129 in the disc 128, the resistance of the sensors goes down providing the ground connection 127 to the microswitch and shorting between 6 and 6a. We now can accomplish this strictly through the microswitch 125 to cause the machine to stop at needle up or down but at a predetermined spot or length as set out by the auxiliary sensor connected to connection 126.

Having described one form of the invention, modifications will be evident to those skilled in the art without departing from the scope of the invention as defined in the appended claims. For example, this invention can be utilised in existing clutch motors or motors which must operate with exact stop locations simply by the addition of a housing which is connected to the hand wheel of the motor or clutch motor by way of a belt and the function will be the same by employing the same embodiments as described in the above invention.

We claim:

1. A control device for use with a motor driven element in a sewing machine or the like, and comprising an auxiliary motor, a clutch mechanism, a main motor having a drive shaft for driving said element through said clutch mechanism, means to disengage said clutch mechanism from said driven element and to activate said auxiliary motor, said auxiliary motor continuing the drive of said driven element after said main motor drive has been disengaged through said clutching mechanism, means indicating a predetermined position where said driven element is to be stopped, sensing means for sensing said means to indicate a position, a floating brake coupling having a movable plate connected to said drive shaft, means to disconnect said auxiliary motor and to magnetically move said movable plate to brake the drive of said driven element in response to said sensing means and within one complete cycle of operation of said element and substantially at said predetermined position.

2. A control device as claimed in claim 1 wherein said braking means is provided between said drive shaft and said floating coupling to slow down said drive element after said main motor is disconnected.

3. A control device as claimed in claim 1 wherein said floating brake coupling comprises a stationary plate secured in close proximity to said drive shaft, said plate having electro-magnetic coils therein for attracting said movable plate when actuated for braking said sleeve.

4. A control device as claimed in claim 1 wherein said means indicating said predetermined position is a spot located in a predetermined position on a wheel associated with the driven element, said sensing means having a pair of photoelectric cells for sensing said spot, said sensing means having a switching circuit means permitting selection of up or down element position and only one of said photoelectric cells corresponding to the selected position to sense said spot whereby said auxiliary motor and said element may be stopped with the element in its up or down position depending on which cell is enabled.

5. A control device as claimed in claim 1 wherein said means indicating said predetermined position is a magnet located in a predetermined position on a wheel associated with the driven element, said sensing means having a pair of reed switches for sensing said magnet, said switching circuit means enabling only one of said reed switches to sense said magnet, whereby said auxiliary motor and said element may be stopped with the element in its up or down position depending on which cell is enabled.

6. A control device as claimed in claim 5 wherein said driven element is a sewing machine needle.

7. A control device as claimed in claim 2 wherein said braking means comprises a coupling to disconnect said main motor from said drive shaft and to slow down said drive shaft, said movable plate being engaged momentarily to cause said slow down of said drive shaft whilst said secondary motor engages the sleeve to continue the drive of said driven element.

* * * * *